United States Patent [19]

Leclaire

[11] Patent Number: 4,729,329

[45] Date of Patent: Mar. 8, 1988

[54] MAGNETIC DETECTION DEVICE FOR SEWING MACHINE WORKPIECE

[75] Inventor: Charly Leclaire, Dourges, France

[73] Assignee: Prouvost S.A., Nord, France

[21] Appl. No.: 869,875

[22] Filed: Jun. 3, 1986

[30] Foreign Application Priority Data

Jun. 3, 1985 [FR] France ..... 85 08319

[51] Int. Cl.[4] ..... D05B 19/00; D05B 29/00

[52] U.S. Cl. ..... 112/272; 112/153; 324/251; 340/674

[58] Field of Search ..... 226/19, 21; 200/61.09; 338/32 H; 340/674; 324/251; 112/272, 447, 153; 73/DIG. 3

[56] References Cited

U.S. PATENT DOCUMENTS

| | | | |
|---|---|---|---|
| 3,408,563 | 10/1968 | Chapman et al. | 324/251 |
| 4,166,423 | 9/1979 | Brienza et al. | 112/254 |
| 4,232,617 | 11/1980 | Garron | 112/447 |
| 4,289,084 | 9/1981 | Tackenoya et al. | 112/235 X |
| 4,337,713 | 7/1982 | Palacino et al. | 112/153 |
| 4,423,691 | 1/1984 | Schwaab | 112/272 |
| 4,565,140 | 1/1986 | Martell et al. | 112/272 X |
| 4,574,719 | 3/1986 | Balke | 112/272 |

FOREIGN PATENT DOCUMENTS

| | | |
|---|---|---|
| 2924206 | 12/1979 | Fed. Rep. of Germany . |
| 2015596 | 9/1979 | United Kingdom . |

*Primary Examiner*—Andrew M. Falik

*Attorney, Agent, or Firm*—Christel, Bean & Linihan

[57] ABSTRACT

A device for detecting the passage of the edge (4*a*) of a piece of material (4), not parallel to the advancing direction (A) of the material for a sewing machine including a presser foot (2), a needle (1) and a needle plate (3). The device comprises a sensor (7) for generating a magnetic field and a sensor (10) responsive to this magnetic field. A magnet is coupled to the presser foor (2) so that it is on the one hand, applied to the piece of material (4) at a point situated at a distance and in front of the needle (1) of the sewing machine relatively to the advancing direction (A) of the material, and on the other hand, is moved with respect to the presser foot (2) in a direction substantially perpendicular to the plane of the needle plate (3). The sensor is mounted opposite the magnet and fixedly in the sewing machine, under the needle plate (3).

6 Claims, 1 Drawing Figure

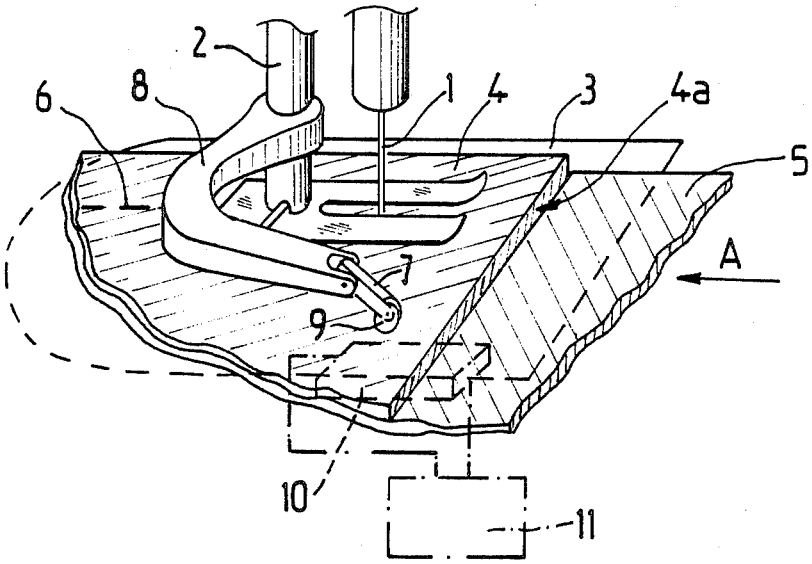
2
6
8
1
4
3
4a
5
A
7
9
10
11

MAGNETIC DETECTION DEVICE FOR SEWING MACHINE WORKPIECE

BACKGROUND OF THE INVENTION

To make a stitching operation automatic, it is often necessary to detect, at the end of stitching, the presence of the edge of the material which intersects the stitching line, so as to be able to determine the distance separating this edge from the needle and to control stopping of the stitching if it is not to reach said edge. This requirement is met with, either when the two pieces of material to be stitched together have their edges superimposed, or when it is a question of stitching a piece of material in the middle of a larger piece. It is also met with during overstitching.

SUMMARY OF THE INVENTION

The present invention provides a simple device for fulfilling this function of detecting the passage of the edge of the material.

For this it provides a device detecting the passage of the edge of the piece of material or fabric, not parallel to the advancing direction of the fabric, for a sewing machine comprising more particularly a presser foot, a needle and a needle plate, characterized in that it comprises means for generating a magnetic field and means sensitive to this magnetic field, the first means being coupled to said presser foot so that they may, on the one hand, be applied against said piece of material at a point situated at a distance and in front of said needle of the sewing machine relatively to said advancing direction of the material and, on the other hand, be moved with respect to said presser foot in a direction substantially perpendicular to the plane of said needle plate, while the other means are mounted opposite the first means and fixedly in the sewing machine under said needle plate.

Advantageously, said means coupled to the presser foot are mounted for pivoting with respect thereto about an axis substantially parallel to said needle plate and perpendicularly to said advancing direction of the material.

The invention will be better understood from the following description of an embodiment given purely by way of non limitative example which will show the advantages and secondary characteristics.

BRIEF DESCRIPTION OF THE DRAWING

Reference will be made to the accompanying drawings in which the single FIGURE is a schematical view of one embodiment of the device of the invention.

DESCRIPTION OF THE PREFERRED EMBODIMENT

A sewing machine, shown only partially, comprises a needle 1, a presser foot 2 comprising a shank and a foot with which it presses the material, and a needle plate 3 on which the material slides which is driven by teeth, not shown, projecting through the needle plate 3.

An L shaped arm 8 is fixedly mounted by one end on the shank of the presser foot 2, in the vicinity of the foot. This arm extends in a plane substantially parallel to the plane formed by the needle plate 3 and has a free end directed forwardly, relatively to the advancing direction A of the material, that is to say towards the portion of the material not yet stitched.

At the free end of arm 8 are mounted for pivoting with respect thereto, about an axis substantially parallel to the needle plate 3 and perpendicular to the advancing direction A of the material, means for generating a magnetic field.

In this example, these means comprise a permanent finger shaped magnet 7 mounted for pivoting by one end on arm 8 and supporting at a second end a rolling means 9. The rolling means 9 is applied to the material by the weight of a permament magnet 7; it prevents the permanent magnet 7 from marking or wearing the material.

Arm 8 and the permanent magnet 7 are dimensioned so that the rolling means 9 is applied to the material at a point situated at a distance and in front of needle 1, relatively to the advancing direction A of the material.

Means sensitive to the magnetic field are mounted opposite the permanent magnet 7 and fixedly in the sewing machine, under the needle plate 3. They comprise, in this example, a Hall effect sensor 10 in the form of a plate disposed parallel to the needle plate.

It is known that such a sensor gives rise to a potential difference between the two main faces of the material which forms it if it has a current flowing therethrough parallel to these two faces and if it is subjected to a magnetic field perpendicular to the flow direction of the current. This sensor 10 is connected to a device 11 using the voltage which it delivers. It is known that this voltage is proportional to the magnetic field to which it is subjected, which means in other words that it is inversely proportional to the distance of the permanent magnet 7 from the sensor 10.

Between the presser foot 2 and the needle plate 3 has been shown two pieces of superimposed material of which the upper piece 4 has an edge 4*a* offset with respect to the edge not shown of the lower piece of material 5. The edge 4*a* is not parallel to the advancing movement A of the material during the formation of a seam 6. Thus, in some cases, the seam 6 must be stopped at a certain distance from the edge 4*a*.

For this, it is useful to detect the passage of the edge 4*a* of the piece of material 4 in front of a given point, in this case the point of application of the rolling means 9 on the piece of material 4. The distance between this point of application and needle 1, measured in the direction of movement A of the material, is greater than the distance which is to separate the end of stitching from edge 4*a*.

When edge 4*a* passes under the rolling means 9 of the permanent magnet 7, the rolling means 9 leaves the upper piece of material 4 and is applied to the lower piece of material 5: the permanent magnet 7 has then been moved towards sensor 10, by a distance corresponding to the thickness of the upper piece of material 4.

The movement of the permanent magnet 7 creates a sudden difference in the magnetic field to which sensor 10 is subjected, which generates a variation of the voltage which device 11 may interpret for outputting a signal to a microprocessor driving the sewing machine. This device is particularly well adapted to the assembly of thick materials such as are met with in the furnishing industry since the movement, on passing over the edge, is of sufficient amplitude to cause a significant variation of the magnetic field to which the sensor 10 is subjected, so that the sensor may output a potential difference variation sufficiently large to be used without ambiguity with respect to the variations generated by surface irregularities of the upper piece of material 4. The device 11 using the output signal of sensor 10 may comprise a procedure for calibrating and adjusting the sensitivity of the sensor so as to obtain good accuracy as to the time when the passage of the edge is detected.

With the above described device, a variation of thickness in the middle of a basic piece of material such as 5 in the FIGURE may be detected or the edge of two thicknesses 4 and 5 which may merge may be detected.

The invention finds an interesting application in the field of sewing machine equipment.

It is not limited to the description which has just been given but covers on the contrary all variants thereof which could be made thereto without departing from the scope and spirit of the invention. Thus it is, more particularly, that a magnetic generator may be used different from the one described not only in so far as its construction but also its coupling to the presser foot are concerned.

Whatever the embodiment adopted, the magnetic generator will have to be able to be moved with respect to the presser foot. In fact, a movement of the presser foot 2 itself because of a change of thickness of material occurs, it is true, when the upper piece of material 4 completely leaves the presser foot 2 but, as will be readily understood, too late for controlling the operation for the end of stitching of this piece of material. This movement of the presser foot can then not be used for controlling the end of stitching operation.

So that the detection of the edge 4*a* of the material may occur in time, the point of application of the magnetic generator on the material will always have to be situated in front of the needle 1.

The magnetic generator which will be used may be held in contact with the material, not only under the effect of its own weight, but for example under the effect of a force generated by a resilient device.

I claim:

1. A device for detecting the passage of the edge (4*a*) of a piece (4) of material, not parallel to the advancing direction (A) of the material, for a sewing machine comprising more particularly a presser foot (2), a needle (1) and a needle plate (3), characterized in that it comprises means (7) for generating a magnetic field and means (10) responsive to this magnetic field, one of said means being coupled to said presser foot (2) so that they are, on the one hand, applied to said piece of material (4) at a point situated at a distance and in front of said needle (1) of the sewing machine relatively to said advancing direction (A) of the material, and, on the other hand, moved with respect to said presser foot (2) in a direction substantially perpendicular to the plane of said needle plate (3), the other means being mounted opposite the first means and fixedly in the sewing machine, under said needle plate.

2. The device according to claim 1, characterized in that said means (7) coupled to the presser foot (2) are mounted for pivoting with respect thereto about an axis substantially parallel to said needle plate (3) and perpendicular to said advancing direction (A) of the material.

3. The device according to claim 2, characterized in that said means (7) coupled to the presser foot (2) comprises a rolling means (9) by which they are in contact with the material.

4. The device according to claim 2, characterized in that said means (7), for generating a magnetic field comprise a permanent magnet.

5. The device according to claim 2, characterized in that said means (10) responsive to a magnetic field comprises a Hall effect sensor.

6. The device according to claim 1, characterized in that said means (7) for generating a magnetic field are coupled to the presser foot (2), the means (10) responsive to said magnetic field being mounted under the needle plate (3).

* * * * *